US010182896B2

(12) United States Patent
Ainley, Jr. et al.

(10) Patent No.: US 10,182,896 B2
(45) Date of Patent: Jan. 22, 2019

(54) ANIMAL INSEMINATION SHEATH AND METHODS OF USE

(71) Applicant: Frank Ainley, Jr., Elderwood, CA (US)

(72) Inventors: Frank Ainley, Jr., Elderwood, CA (US); Wess Fallon, Kirkland, WA (US); Roger Pangan, Kirkland, WA (US)

(73) Assignee: Frank Ainley, Elderwood, CA (US)

( * ) Notice: Subject to any disclaimer, the term of this patent is extended or adjusted under 35 U.S.C. 154(b) by 324 days.

(21) Appl. No.: 15/063,780

(22) Filed: Mar. 8, 2016

(65) Prior Publication Data

US 2017/0258568 A1 Sep. 14, 2017

(51) Int. Cl.
*A61D 19/02* (2006.01)

(52) U.S. Cl.
CPC ..... *A61D 19/027* (2013.01)

(58) Field of Classification Search
CPC ..... A61B 17/425; A61B 17/43; A61B 17/435
(Continued)

(56) References Cited

U.S. PATENT DOCUMENTS 3,160,156 A 12/1964 Tyler
3,811,443 A 5/1974 Dickinson, III et al.
(Continued)

FOREIGN PATENT DOCUMENTS

DE 4309808 C 6/1994
EP 1066802 A 1/2001
GB 867274 S 5/1961

OTHER PUBLICATIONS

Robert E Taylor; Scientific Farm Animal Production, An Introduction to Animal Science; 1992; p. 197; Macmillan Publishing Company, New York, USA.

(Continued)

*Primary Examiner* — Samuel Gilbert
(74) *Attorney, Agent, or Firm* — Mark D. Miller

(57) ABSTRACT

The present invention provides an artificial insemination apparatus and methods for use with livestock that maintains the sterility of the semen until it is deposited at an optimum location in the reproductive tract of the animal without the maneuvering or tissue injury problems associated with prior art devices. Embodiments of the present invention comprise a uniquely shaped opening that is provided at the tip of a sheath that is used with an artificial insemination gun, and a movable or deformable plug or diaphragm that fits into and covers this opening. The plug or diaphragm has a rounded (convex) exterior surface, and may be made of a rigid or rubberized material that completely covers the opening at the tip of the sheath, and seals it closed in a smooth, flush engagement to prevent contaminants from collecting upon the tip, or entering into the sheath during the trip through the reproductive tract of the animal. Once the sheath is properly placed in the reproductive tract, application of fluid pressure to the semen inside the sheath causes the plug to move or deform without becoming detached from the sheath, thereby allowing semen inside the sheath to exit. In alternative embodiments, the unique tip with its opening and corresponding plug may be provided in a separate cap that is installed at the end of an insemination sheath.

32 Claims, 14 Drawing Sheets

(58) Field of Classification Search
USPC .... 600/33–35, 184, 186, 201, 462; 604/1–3, 604/93.01, 96, 181, 184, 187, 236, 238, 604/263, 264, 275, 510, 515, 906; 119/14.21, 174
See application file for complete search history.

(56) References Cited

U.S. PATENT DOCUMENTS

| | | | | |
|---|---|---|---|---|
| 3,877,430 | A | 4/1975 | Wieder | |
| 3,910,275 | A | 10/1975 | Babey et al. | |
| 4,006,849 | A | 2/1977 | Van Vroenhoven | |
| 4,173,227 | A | 11/1979 | Cassou et al. | |
| 4,261,361 | A | 4/1981 | Cassou | |
| 4,262,494 | A | 4/1981 | Karow, Jr. | |
| 4,312,350 | A | 1/1982 | Doan | |
| 4,368,732 | A | 1/1983 | Cassou et al. | |
| 4,380,997 | A | 4/1983 | Leibo | |
| 4,419,986 | A | 12/1983 | Leibo | |
| 4,453,936 | A | 6/1984 | Cassou | |
| 4,457,313 | A | 7/1984 | Alter | |
| 4,474,576 | A | 10/1984 | Gobby | |
| 4,478,261 | A | 10/1984 | Cassou et al. | |
| 4,493,700 | A | 1/1985 | Cassou | |
| 4,522,621 | A | 6/1985 | Cassou | |
| 4,586,604 | A | 5/1986 | Alter | |
| 4,662,360 | A | 5/1987 | O'Hara et al. | |
| 4,846,785 | A | 7/1989 | Cassou | |
| 4,865,589 | A | 9/1989 | Simmet et al. | |
| 5,190,880 | A | 3/1993 | Cassou et al. | |
| 5,249,610 | A | 10/1993 | Cassou et al. | |
| 5,293,862 | A | 3/1994 | O'Hara et al. | |
| 5,474,542 | A | 12/1995 | Gandi et al. | |
| 5,496,272 | A | 3/1996 | Chung et al. | |
| 5,562,654 | A | 10/1996 | Smith | |
| 5,674,178 | A | 10/1997 | Root | |
| 5,800,411 | A | 9/1998 | Nakada et al. | |
| 5,868,178 | A | 2/1999 | Lecointe | |
| 5,868,661 | A | 2/1999 | Williams et al. | |
| 5,868,662 | A | 2/1999 | Borodulin et al. | |
| 5,899,848 | A | 5/1999 | Haubrich | |
| 5,916,144 | A | 6/1999 | Li et al. | |
| 5,971,971 | A | 10/1999 | Saint-Roman et al. | |
| 5,997,481 | A | 12/1999 | Adams | |
| 6,010,448 | A | 1/2000 | Thompson | |
| 6,071,231 | A | 6/2000 | Mendoza et al. | |
| 6,116,193 | A | 9/2000 | Goeckner | |
| 6,117,068 | A | 9/2000 | Gourley et al. | |
| 6,347,243 | B1 | 2/2002 | Fraden | |
| 6,454,756 | B1 | 9/2002 | Sasaki | |
| 6,511,415 | B1 | 1/2003 | Christine | |
| 6,520,922 | B2 | 2/2003 | Michelle | |
| 6,527,703 | B2 | 3/2003 | Simmet | |
| 6,662,750 | B2 | 12/2003 | Anderson | |
| 6,676,596 | B2 | 1/2004 | Erwin et al. | |
| 6,913,593 | B1 | 7/2005 | Alexandre et al. | |
| 6,929,598 | B2 | 8/2005 | Kaneko et al. | |
| 6,945,953 | B2 | 9/2005 | Wright | |
| 6,964,656 | B2 | 11/2005 | Saint-Roman et al. | |
| 7,056,279 | B2 | 6/2006 | Verberkmoes | |
| 7,175,590 | B2 | 2/2007 | Christine | |
| 7,241,261 | B2 | 7/2007 | Hladky | |
| 7,291,104 | B2 | 11/2007 | Neisz | |
| 7,344,492 | B2 | 3/2008 | Ainley, Jr. | |
| 7,419,465 | B2 | 9/2008 | Ainley, Jr. | |
| 7,837,611 | B2 | 11/2010 | Ainley, Jr. | |
| 8,323,178 | B2 * | 12/2012 | Ainley, Jr. ..... | A61D 19/027 600/35 |
| 2001/0023310 | A1 | 9/2001 | Gourley | |
| 2002/0193658 | A1 | 12/2002 | Simmet | |
| 2003/0178440 | A1 | 9/2003 | Wright | |
| 2003/0212307 | A1 | 11/2003 | Hladky | |
| 2004/0068159 | A1 | 4/2004 | Neisz et al. | |
| 2004/0134441 | A1 | 7/2004 | Anderson et al. | |
| 2004/0162461 | A1 | 8/2004 | Christine | |
| 2004/0199044 | A1 | 10/2004 | Verberckmoes | |
| 2005/0288606 | A1 | 12/2005 | Alter | |
| 2007/0255092 | A1 | 11/2007 | Ainley, Jr. | |
| 2011/0087065 | A1 * | 4/2011 | Liu ..... | A61D 19/027 600/35 |
| 2015/0320444 | A1 * | 11/2015 | Brown ..... | A61D 19/027 600/35 |

OTHER PUBLICATIONS

W.M. Graves, A.K. McLean; Solving Postpartum Breeding Problems, Bulletin 1211; Apr. 2002; University of Georgia College of Agricultural and Environmental Sciences; available at pubs.caes.uga.edu/caespubs/pubcd/B1211.htm.

J. Labernia, F. Lopez-Gatius, P. Santoloria, M. Lopez-Bejar, J. Rutllant; Influence of management factors on pregnancy attrition in dairy cattle; Theriogenology; 45:1247-1253; 1996.

F. Lopez-Gatius, J. Labernia, P. Santoloria, M. Lopez-Bejar, J. Ruttlant; Effect of reproductive lisorders previous to conception on pregnancy attrition in dairy cows; Theriogenology; 46:643-648; 1996.

Printout of website; http://www.continentalplastic.com/Cattle.htm; retrieved Oct. 15, 2008.

Artificial Insemination Sheath, Bureau of Indian Standards (1991).

Dr. M.L. O'Connor; Artificial Insemination Technique, IRM-12; Pennsylvania State University; available at http:// extension.psu.edu/animals/dairy/health/reproduction/insemination/artificial-insemination-technique (2003).

* cited by examiner

SIDE VIEW CROSS-SECTION

TOP VIEW CROSS-SECTION

SECTION C-C
TOP VIEW CROSS-SECTION

SECTION B-B
FRONT VIEW CROSS-SECTION

TOP VIEW

END VIEW

SIDE VIEW

ISO VIEW

DIAPHRAGM SHAPE DURING INJECTION

TOP VIEW AND
SIDE VIEW

ISO VIEW

DIAPHRAGM SHAPE AT REST

PRIOR TO USE
TOP VIEW
CROSS-SECTION

PRIOR TO USE
FRONT VIEW
CROSS-SECTION

DURING
INJECTION
TOP VIEW
CROSS-SECTION

DURING
INJECTION
FRONT VIEW
CROSS-SECTION

ANIMAL INSEMINATION SHEATH AND METHODS OF USE

BACKGROUND OF THE INVENTION

1. Field of the Invention

The present invention relates to animal insemination, and more particularly to methods and apparatus for inseminating livestock, particularly bovine and related animals.

2. Description of the Prior Art

The artificial insemination of livestock is a common practice, and extensive research and studies have been done to confirm the benefits including increased conception rates. A few devices are currently on the market for use in insemination, especially with respect to the cattle and dairy industry. Most devices currently in use include a syringe of some general design, which contains a unit of semen. The syringe is inserted into the reproductive tract of the animal to deposit the semen in such a location to ensure heightened reproductive success.

The primary goal of and benefit derived from artificial insemination is the ability to select and ensure the delivery of superior genetic traits and to provide improved pregnancy rates. Many factors can affect the pregnancy rate of a herd being artificially inseminated. One factor is the ability to detect when members of the herd are in heat and should be inseminated. Another is the general reproductive health of the female members of the herd. Another factor is the effectiveness of the semen. Another factor is the effectiveness of the artificial insemination procedure being used. Improving the first three factors requires close study of the herd, and testing the reproductive tracts and units of semen being used for any potential problems. A final factor, the effectiveness of the artificial insemination technique, is largely affected by the artificial insemination devices used, and the processes and techniques that are used. With regard to these issues, devices for artificial insemination have been created to be able to quickly and safely deliver semen to a given animal. While a few devices are on the market, there are disadvantages to such devices that either lower their efficiency or make them difficult to use, dissuading a large percentage of technicians from choosing to use them.

Pregnancy efficiency levels are critical since they correlate directly to the cost of breeding livestock. If efficiency is low, more insemination attempts will be needed on average to impregnate a given animal. This translates to a loss of time and profit while the animal is not pregnant, labor costs for the breeder to continue the insemination attempts on the animal, the money cost for more semen to be used, and extra insemination supplies needed for the extra attempts. Thus, an overall increase in efficiency can greatly increase the profitability of a given herd.

One of the more common devices used for the artificial insemination is a gun or syringe having a plunger rod inside that may be enclosed within a sheath. Such a device is disclosed in U.S. Pat. No. 4,493,700. In such a device, a straw containing a unit of semen is placed into the tubular body of the gun, and the sheath placed over the gun-and-straw combination. The contents of the straw may be expelled when the plunger inside the tubular body is depressed. A typical semen straw is sealed at one end by cotton plugs, and at the other end by a crimp seal. When the straw is ready for use, the crimped end of the straw is cut off, opening this end of the straw for passage of the semen. The straw is then inserted into the tubular body of the gun, with the closed end against the plunger, and the open end extending out from the tubular body. Then, the plastic sheath is placed over the tubular body and straw. Both ends of the sheath are open, with the proximal end being of a slightly larger diameter in order to receive the semen straw and tubular body, the distal end having a more narrow frusto-conical pointed end or tip. The open split (proximal) end is secured to the gun by means of a locking ring. The tip of the sheath (distal end) is pointed but open to allow for the delivery of semen from the straw. The sheath-covered "loaded" gun is then inserted into the vaginal tract of the animal to be inseminated and, at the proper location, semen is delivered by depressing the plunger. It is to be appreciated that proper insertion and maneuvering of the sheathed gun involves considerable skill as the technician must first direct the pointed end of the sheathed gun assembly through the vaginal canal, then to and through the cervix, and finally to an optimum delivery point at the entrance of the uterine body before the semen is delivered. The slender makeup of such devices makes them well suited for such maneuvering. However, the open-ended sheath suffers from the significant drawback of potential loss of sterility during the long journey to the delivery point, such that even if delivery is made at an optimum location, the semen may have become contaminated along the way rendering it ineffective and/or unusable.

The vaginal canal of most livestock may be unsanitary, the passageway containing bacteria, yeast, and other deleterious organisms. Another problem with bovines is that the vagina is located below the anus, and as such, it is commonplace for some amount of manure to find its way into the vaginal cavity. The manure by nature is unsanitary, and if it is introduced into the cervix or uterus, it will most likely lower reproductive levels to a minimum and cause infection and/or disease. The open-tipped insemination gun may come into contact with and collect these contaminants as it passes through the vaginal cavity, causing them to be deposited with the semen at the delivery point. It is therefore desirable to provide methods and apparatus for artificial insemination that assure sanitary and efficient delivery of the semen to the uterine body.

This problem is partially addressed in U.S. Pat. No. 4,457,313. The devices disclosed in this patent use a disposable rigid protective or outer sheath that fits over the inner sheath of the insemination gun to maintain the sterility of the inner sheath and semen straw inside. The outer protective sheath is formed of a hard plastic and is not as long as the inner sheath. The outer sheath is provided with a perforated rubber cap at one end and a flared gripping surface at the other. The rubber cap prevents contaminants from entering the open end of the pointed sheath and semen straw inside during the long trip through the reproductive tract. When the delivery point is reached, the flared gripping surface is grasped and pulled, sliding the outer sheath relative to the inner sheath (which is why it is shorter than the inner sheath), and causing the inner sheath to push or poke through the perforated rubber cap. The semen can then be delivered by depressing the plunger.

Unfortunately, devices of this sort suffer from numerous drawbacks. The most significant is the obstacle created by the large rubberized cap. While this cap aids sterility, it is bulky and tends to get caught or snag during the trip through the vagina, and is likely to become entangled or stopped (plugged) in the fibrous tissues of the cervix. This makes it difficult for the user to maneuver the tip to the optimum location for deposit of the semen. For smaller animals, the cap may simply be too large to even fit into the cervix. In either case, the rubberized cap prevents the gun from being maneuvered all the way to the uterine body for optimal semen delivery. As a result, at the point where the rubber cap prevents further insertion, the inner sheath must then be pushed through the perforated end of the cap to travel further toward its destination. If the cap has bogged down in the vagina, extending the inner sheath will expose it to the very contaminants sought to be avoided. If the cap has made it to the cervix, further contaminants may still be picked up. In either case, the now bogged-down cap tends to inhibit further maneuvering of the inner sheath (which is passing through it), leading to imprecise positioning and less than optimum deposition of semen. In addition, since the outer protective sheath is of a certain length, even when the user extends the inner sheath the maximum distance through the perforated end of the cap (this distance is the difference between the lengths of the inner and outer sheaths), there is only so much traveling space before the outer sheath rests upon the base of the gun at the plunger, thereby preventing the inner sheath from traveling any further on its own. Oftentimes, this distance is less than the length of the cervix, thereby preventing the tip of the inner sheath from reaching the optimum location at the entrance of the uterine body, decreasing the chances of fertilization.

Another drawback is that the use of the outer sheath increases the size and diameter of the insemination gun, which already includes a first sheath placed over the gun tube, plunger and semen straw. The outer sheath is loosely attached (so that it can slide against the inner sheath), making it more difficult to maneuver. All of these things inhibit the technician from feeling the depth of the insemination gun, contributing to a general lack of ability to feel the placement of the tip of the gun, and making it less likely to deposit the semen in an optimal location.

Because of these problems, many breeders have a difficult time inseminating animals with such devices, and oftentimes choose to use the unsanitary gun or sheath without the protective device. This is usually because the insemination process is based largely on the "feel" the breeder has leading the device through the reproductive tract of the animal, and the sense of location that an experienced breeder acquires though repeated breeding. When breeders discuss "feeling" placement of the artificial insemination gun in the reproductive tract, a central focus is on the travel of the instrument to and though the cervix. The cervix is much more rigid than the vaginal lining, and creates more resistance on the artificial insemination instrument. Depending on the animal and its age, the size, shape, and diameter of the cervix can vary greatly. In general, the cervix in both older and larger livestock is larger and longer than that of younger, smaller livestock. Often times, the angle at which the cervix rests is more downward with an older animal. These differences in cervix size and shape underscore the problems with many of the sanitary devices currently on the market.

Other devices have also been developed to attempt to further sanitize the process. One such device is disclosed in U.S. Pat. No. 4,453,936. This device is a sleeve of thin plastic material such as a film, which covers the gun and inner sheath. The gun is inserted in the reproductive tract of the animal with the film in place over the gun, and once the gun is in the proper location to inseminate the animal, the technician pulls on the film to create a lateral force to tear the film by the pressure on the sleeve at the end of the gun, thereby allowing a passage for the semen from the tip of the inner sheath. Many problems have been encountered with such devices, making them unpopular to breeders and rarely used. While the sleeve is intended to make the insemination process more sanitary, it is found that the sleeve bunches in places during insertion creating pockets where contaminants from the vagina are carried further into the cervix and uterus actually increasing the chance of infection. Another problem with such devices is that the edge of the sleeve where the plastic film is connected tends to cut the vaginal lining, causing bleeding in the animal. This causes general discomfort for the animal and increases the chance for infection. It is also known that blood can kill sperm. Finally, many breeders also complain that the film sleeve affects the "feel" needed to properly inseminate the animal.

In response to the above drawbacks, an insemination sheath having a thin protective membrane at the tip with a pre-scored or pre-pricked area thereon was developed, as disclosed in U.S. Pat. No. 8,323,178 and its ancestry. The pre-scored or pre-pricked area is ruptured using fluid pressure from the semen straw during semen delivery. However, the pre-scored or pre-pricked area may develop a slight indentation that can collect unwanted materials as it travels through the reproductive tract. Because the indentation is located at the end of the tip of the sheath, it may not be possible for the breeder/user to wipe it completely clean using the other hand in the rectal tract.

A number of other artificial insemination devices have been developed which include a nozzle having a generally spherical head attached to a hollow neck located at the end of an insemination sheath, where lateral openings are provided in the neck. See U.S. Pat. No. 4,654,025, French Patent No. FR2574656 and U.S. Patent Application Publication No. 2015/0112124. In each of these inventions, sliding movement imparted to the semen straw itself causes the head and neck apparatus to be extended out from the end of an insemination sheath, exposing the lateral openings in the neck through which semen may then be delivered. However, each of these devices requires mechanical pressure to push the nozzle open, thereby requiring a second plunger (one plunger to move the semen straw, and another to eject the semen itself). These devices also require an additional internal sheath requiring additional space inside the outer sheath, resulting in a bulky and cumbersome apparatus that is more rigid and difficult for the user to maneuver. The additional parts in these devices also make them more likely to clog or otherwise fail in comparison to less-complicated devices with fewer parts.

It is therefore desirable to provide methods and apparatus for providing sanitary artificial insemination of a wide variety of livestock, while also allowing the breeder to have the necessary tactile sensation for proper placement of the insemination gun for delivery of semen at an optimal location to improve the chances of fertilization.

SUMMARY OF THE INVENTION

The present invention provides an artificial insemination apparatus and methods for use with livestock that maintains the sterility of the semen until it is deposited at an optimum location in the reproductive tract of the animal without the maneuvering or tissue injury problems associated with prior art devices. Embodiments of the present invention comprise a uniquely shaped opening that is provided at the tip of a sheath that is used with an artificial insemination gun, and a movable or deformable plug or diaphragm that fits into and covers this opening. The plug or diaphragm has a rounded (convex) exterior surface, and may be made of a rigid or rubberized material that completely covers the opening at the tip of the sheath, and seals it closed in a smooth, flush engagement to prevent contaminants from collecting upon the tip, or entering into the sheath during the trip through the reproductive tract of the animal.

In some embodiments, the plug or diaphragm is designed to slide forward under the pressure from the seminal fluid being provided by the force of the plunger of the insemination gun. This pressure is applied once the tip has been maneuvered into position. The motion of the plug or diaphragm is arrested after it slides forward a short distance, without becoming detached. This prevents the plug or diaphragm from being left behind in the reproductive tract after insemination. The movement of the plug or diaphragm in these embodiments exposes the uniquely shaped opening at the tip of the insemination sheath. This opening includes at least one side channel through which semen may escape from inside the sheath. The plug or diaphragm is designed to fit flush with the end of the sheath providing a smooth tip so as to avoid accumulating unwanted impurities or causing damage to the reproductive tract during the trip to the uterine area. In these embodiments, the plug or diaphragm is preferably made of a rigid or semi-rigid material.

In most embodiments, a specially shaped head or cap is provided which is designed to be attached to the end of the insemination sheath. This head or cap has a rounded tip and includes the special opening having one or more side channels therein that is covered by the plug or diaphragm. In most embodiments, this head or cap is designed to fit into the end of the insemination sheath so as to provide the desired rounded tip without increasing the diameter of the sheath, and without requiring any additional outer sheath or film that might otherwise interfere with maneuvering the device. As a result, embodiments of the present invention allow the breeder to have optimum tactile sensitivity for proper placement of the device and deposit of semen. In alternative embodiments, the opening with the one or more side channels therein is provided as part of the rounded end of the insemination sheath itself, such that no additional head or cap is required, this opening being covered by a plug or diaphragm.

Other embodiments of an apparatus of the present invention include a deformable plug or membrane provided over the uniquely shaped opening at the tip of the insemination sheath or cap. In these embodiments, instead of sliding a short distance forward when fluid pressure is applied, the edges of the plug or membrane deform under this pressure. This deformation exposes the one or more channels in the opening at the end of the insemination sheath or cap, allowing the semen to escape. As with other embodiments, the specially shaped opening is provided at the end of the insemination sheath (either in an attachable cap or head, or as part of the sheath itself), and the deformable plug or membrane provides a flush covering of the opening which seals it closed during the trip through the reproductive tract, thereby avoiding accumulation of unwanted materials and avoiding injury to the reproductive tissues.

The process of using the sealed sheath of the present invention with an insemination gun first requires preparation of the sheath, semen straw and gun. The plug or diaphragm should be inserted into the uniquely shaped opening at the tip of the sheath to seal it closed. This may be done by the user, but is preferably accomplished as part of the process of manufacturing the sheath or cap, such that the sheath or cap comes with the plug or diaphragm already in place in the unique opening. The plug or diaphragm should be flush with the surface of the sheath or cap, with a slightly outwardly rounded shape. The plug or diaphragm may be designed to react in one of two ways when fluid pressure is applied: it either slides out a short distance, or it deforms slightly, thereby exposing one or more channels in the unique opening. If the sheath is provided with the opening as part of the sheath itself, then the user need only confirm that the plug or diaphragm is properly in place before attaching the sheath to the insemination gun. If the opening is provided in a separate cap, then the cap must be inserted onto or attached to the end of the sheath, and the plug or diaphragm checked to be sure it is properly in place before attaching the sheath to the insemination gun.

In preparing the semen straw, it is first thawed from a frozen state. The semen straw comes completely sealed, having a slidable plunger seal at one end and a plastic (crimp) seal at the other end. Once thawed, the crimped end of the straw is cut off. The semen straw is then inserted into the insemination gun, with open end extending out. The gun comprises a cylindrical tube of slightly larger diameter than the semen straw, in which an elongate plunger mechanism is situated. The straw is inserted into the tube and the plunger mechanism of the insemination gun rests upon the slidable plunger seal at the base of the semen straw. An insemination sheath of the present invention (having the unique end opening that is covered flush by a plug or diaphragm) is then placed over the length of the gun. The insemination sheath is approximately the same length as the gun such that the base of the sheath (proximal end) fits snugly against a flared lower portion of the gun tube. The cylindrical tube of the artificial insemination gun flares out slightly to a larger diameter at the base to allow for the sheath to be properly attached. An "O" ring is then slid over the plastic sheath and is locked into place over this larger diameter area near the base of the gun, holding the proximal end of the sheath firmly against the gun tube. The plunger of the gun should be depressed to the point of contacting the cotton plunger in the semen straw. Because of the narrow circumference of the sheath tip (distal end), it is not possible for the semen straw to exit the sheath and gun assembly. At this point in time, the gun is prepped, and the unit of semen is loaded and open, but remains sealed to the external environment because the plug or diaphragm is covering the unique opening at the tip of the sheath.

The breeder then inserts the gun in the reproductive tract of the animal in the usual fashion. In one method, the breeder inserts the gun the majority of the length of the vagina, and then using his or her other hand, proceeds to gently wipe off the tip of the sheath to ensure that no contaminants are stuck or lodged near the tip. This is possible due to the elastic nature of the intestinal and vaginal lining through which the breeder can feel and manipulate the tip. The flush, rounded fit between the plug and the opening at the end of the sheath makes it possible to wipe the tip of the sheath completely clean. The tip of the sheath is then inserted and navigated into the cervix of the animal.

The breeder then navigates the tip of the insemination gun to the appropriate area in the uterine body where the semen is to be deposited. At this point, the breeder depresses the plunger or other mechanism. The fluid pressure of the semen caused by this action dislodges or deforms the plug or membrane, thereby exposing the one or more channels in the opening at the end of the sheath, allowing the semen to be released into the uterine body. Once the semen is deposited, the gun is removed from the animal, and the used outer sheath is discarded along with the used semen straw.

Because of the conforming nature of the cap and cover on the sheath of the present invention, it does not affect the movement of the gun, or the tactile sensitivity of the gun to the breeder, allowing the breeder to properly navigate the tip of the gun to the proper location for discharge of semen at an optimum location in the uterine body.

In addition to increasing pregnancy rates, a further benefit of the present invention is a reduction in the rate of ovarian cysts in animals inseminated compared to animals inseminated by the prior art. Cystic ovaries is a condition that naturally occurs in a small percentage of animals, the occurrence of which lowers reproductivity rates in said animals. A cystic state can approximate that of the animal being in estrous causing a breeder to attempt to inseminate the animal to no effect. In addition, ovarian cysts require medical attention to prevent harm to the reproductive tract. The treatment for cysts takes usually at least 3 weeks, which is time lost for the possible insemination of the animal. The exact cause of ovarian cysts is unknown, but it is possible that the reduction in cysts is based on the fact that the present invention creates less irritation to the animal's reproductive tract when used due to the increased level of sanitation and reduction in circumference in the device. The use of the prior art large rubber tipped sheath protector is a possible cause of trauma to the reproductive tract and likely causes the secretion of prostaglandin which would trigger a short heat cycle, and an infertile heat. The use of the present invention reduces the trauma level of the animal due to its reduced size, which is potentially a direct corollary to reduced numbers of cystic ovaries.

Another concern with inseminating animals is the possibility of infection. Oftentimes, if an animal is subject to an infection in the reproductive tract, the animal will skip a reproductive cycle. Such an infection could be caused by the contaminants deposited in the reproductive tract that were picked up by an unsealed sheath tip. The reproductive cycle for cattle is roughly 3 weeks. If an animal is infected, and skips a reproductive cycle, then the breeder will have to wait 6 weeks before insemination can be attempted, and an overall loss of revenue.

It is therefore an object of the present invention to improve pregnancy rates among artificially inseminated livestock by providing methods and apparatus for avoiding contamination of semen to be deposited during artificial insemination that do not interfere with the breeder's navigation of the insemination device through the animal's reproductive tract.

It is a further object of the present invention to provide a sheath for use with an artificial insemination gun having a uniquely shaped opening at the end thereof that is covered by a plug or diaphragm to prevent contaminants from entering the sheath as it travels through the reproductive tract of an animal, the plug or diaphragm being dislodged or deformed upon the application of the pressure used to discharge the semen, thereby allowing semen to pass through one or more channels in said unique opening.

It is a further object of the invention to provide a protective seal for an artificial insemination sheath without the need for another larger sheath or plastic film covering.

It is a further object of the invention to provide a protective cover for an artificial insemination sheath that does not affect the tactile sensation of the breeder navigating the gun to the proper location within the reproductive tract of an animal.

It is a further object of the invention to provide cost effective and efficient methods for avoiding contamination of semen used in artificial insemination of livestock.

It is a further object of the invention to provide methods and apparatus for depositing semen, antibiotics or other materials into the reproductive tract of an animal.

It is further object of the invention to provide methods for installing a protective cap on the end of a standard artificial insemination sheath.

Additional objects of the invention will be apparent from the detailed descriptions and the claims herein.

DETAILED DESCRIPTION

Figure 1:
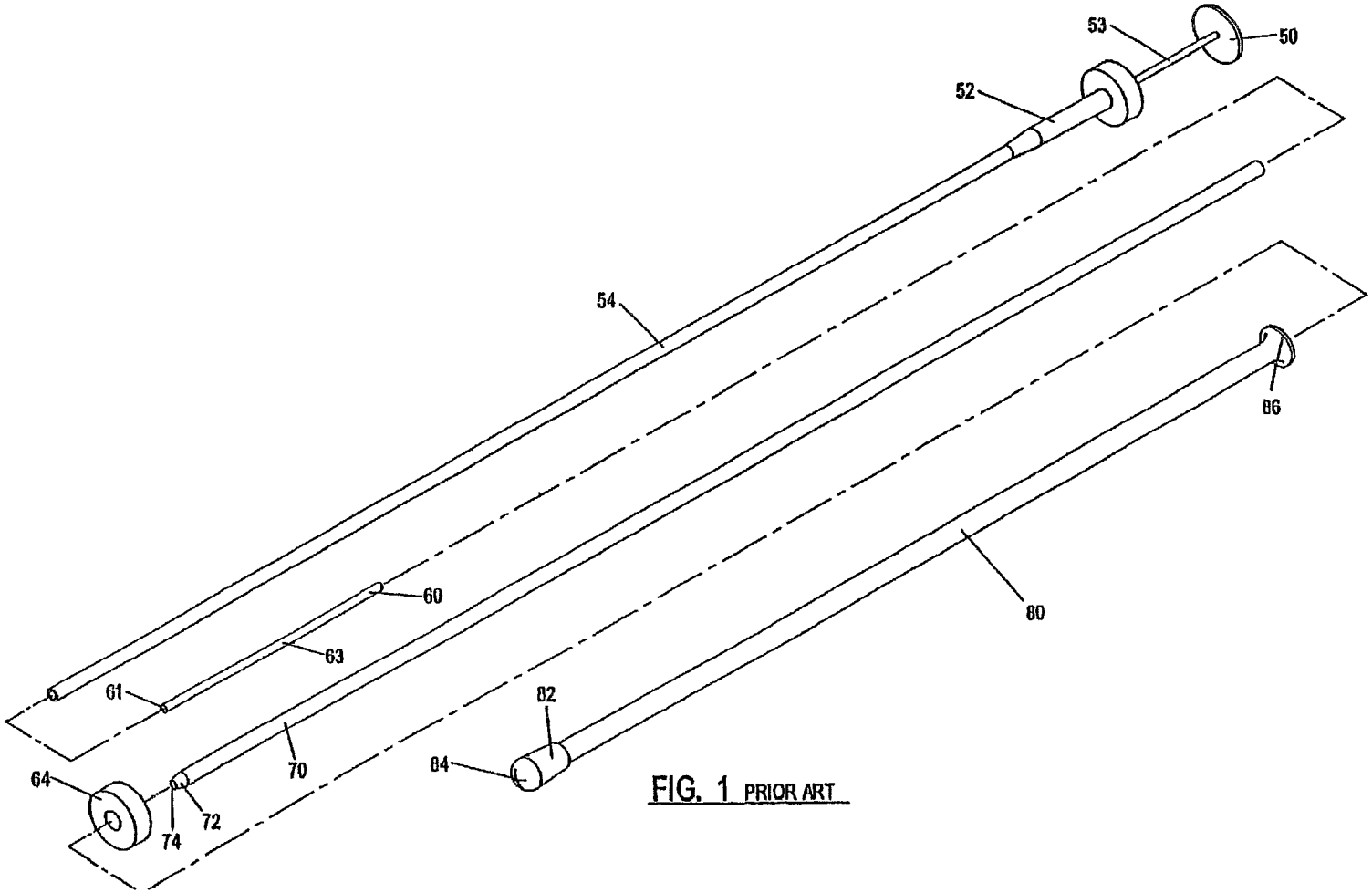
FIG. 1 PRIOR ART
FIG. 1 is a schematic view of a prior art artificial insemination gun using a sheath protector having a large rubberized cap at the end.
Figure 2:
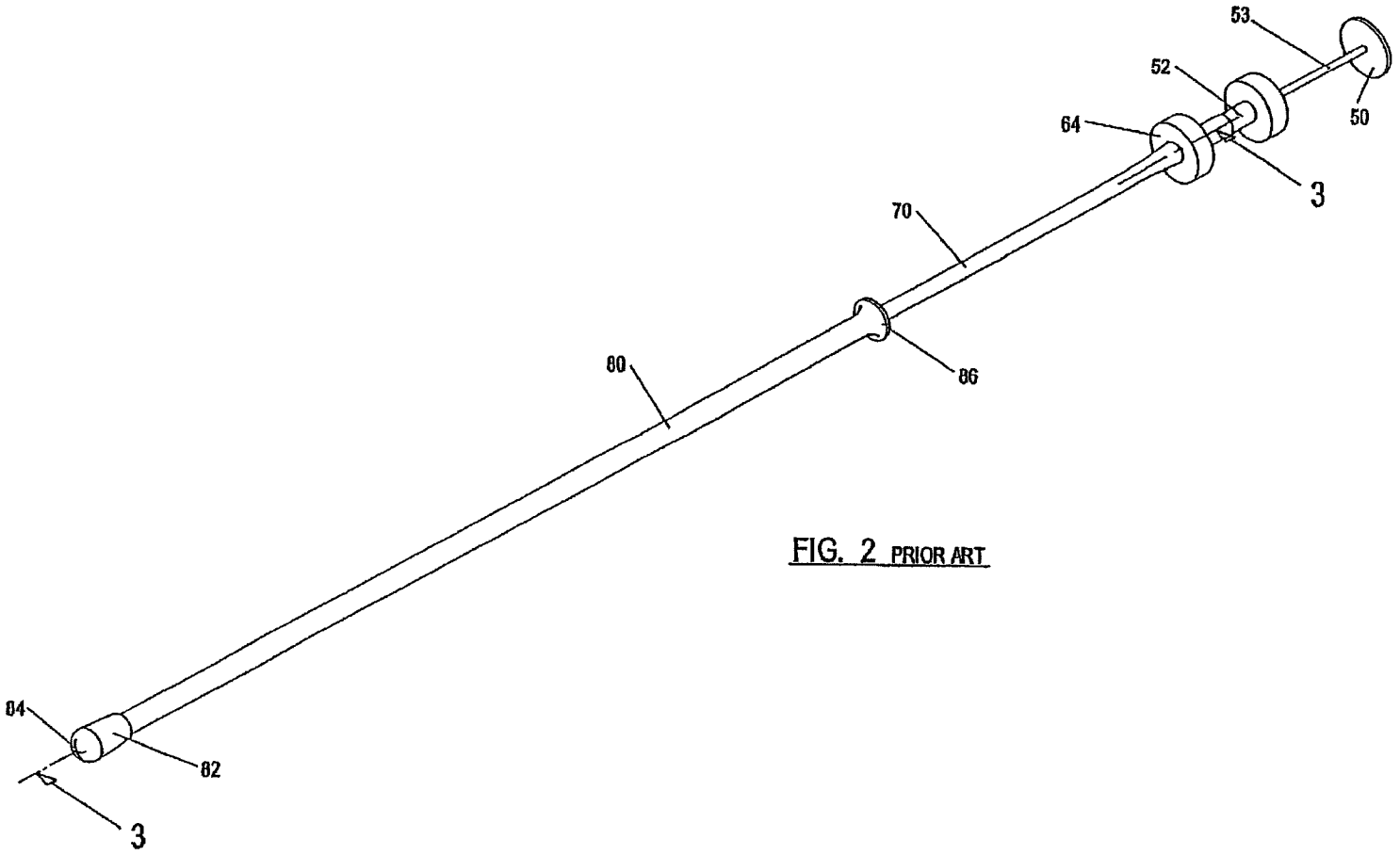
FIG. 2 PRIOR ART
FIG. 2 is a side perspective view of the prior art embodiment of FIG. 1 in an assembled state, prior to use.

Referring to the drawings wherein like reference characters designate like or corresponding parts throughout the several views, and referring particularly to the prior art devices of FIGS. 1 and 2, it is seen that the artificial insemination gun, used particularly for bovines, comprises a tubular body 54 provided at one end with a head 52 for fixing a sheath and terminating in an annular flange 50 that is held in the technician's fingers. Adjacent to its other end, body 51 has a counterbore defining an inner shoulder against which bears one end of a supply of semen or straw 63 provided with a piston-plug 60. Body 54 further comprises a plunger-rod 53 which is slidably mounted in the body 51 so as to be capable of shifting by an end thereof the piston-plug 60 and consequently ejecting the semen contained in the straw 63. At its other end, the plunger-rod 53 has a flange 50 for pushing when dislodging semen. Body 54 and the plunger-rod 53 are, for example, made from stainless steel.

The gun is completed by a cylindrical breeding sheath 70 which slides over and covers the whole of the body 54 and the straw 63. The straw 63 bears by its front end against the inner surface of a convergent portion 72 of this sheath which has an ejection orifice 74. At its other end, the sheath is elastically clamped against a flared frustoconical portion of the head 52 by means of a clamping or "0" ring 64. The semen straws are crimp sealed on one end, and the crimped end of the straw is removed before use, creating an opening 61 through which the semen can be expelled. Sheath 70 is disposable, and is employed for each insemination operation and is slipped over the gun before its insertion into the reproductive passages of the animal. The sheath 70 is discarded once the apparatus has been withdrawn from the animal, so that the gun proper 54 is not soiled and may be again employed without inconvenience on another animal after having been covered with another sheath.

Once the straw 63 is in place, the sheath 70 is slid over the artificial insemination gun shaft 51 and the semen straw. The sheath is made of a thin plastic material that is of slightly larger diameter than the shaft 51 of the insemination gun 54. When the open end of the semen straw 61 reaches the convergent portion of the sheath 72, a snug and/or airtight fit is accomplished and creates a seal with the convergent portion of the sheath 72. This seal is maintained by a locking ring which is slid over the sheath 70, and is of a diameter just slightly larger than a portion of the base of the sheath, as to allow the locking ring 64 to be manually secured on the sheath by applying downward force on the ring 64. Once secured, the semen straw 63 is secured in place as the tip of the sheath 72 narrows in diameter creating a lip or edge preventing the semen straw from exiting the sheath.

After securing the sheath 70 in the prior art embodiment of FIGS. 1 and 2, a protective or outer sheath 80 may then be placed over the inner sheath 70. The outer sheath 80 is made of a thicker plastic material and is of a diameter large enough that it fits loosely over the inner sheath 70. The outer sheath 80 is shorter in length than the inner sheath 70. The tip of the prior art outer sheath 80 is covered by a rubberized cap 82. The rubberized cap 82 has slits 84, usually formed in an "x" pattern, which allow the inner sheath 70 to be extended though the tip 82 by applying downward pressure on the flared edge 86 of outer sheath 80 with respect to the inner sheath 70 and the rest of the insemination gun apparatus 54. The outer sheath 80 and cap 82 are intended to cover the inner sheath 70 while the insemination gun assembly 54 is traveling through the vagina where contaminants might otherwise enter through opening 74 in sheath 70.

FIG. 1 is a schematic view of the components of the artificial gun assembly of the prior art insemination device. FIG. 2 depicts an embodiment of the prior art artificial insemination sheath in an assembled state. As shown, the outer sheath 80 is of a shorter length than the inner sheath 70. The end of the outer sheath has slits 84, but remains in a closed position while resting on the end of the tip of the inner sheath. 70. Once the device is inserted to the base of the cervix of the animal the breeder applies downward pressure on the flared section 86 of the outer sheath to force the tip 72 of the inner sheath 70 through the slits 84 of the rubber tip 82 of the outer sheath 80. The outer sheath can then slide downward until the flared section 86 comes in contact with the locking ring 64. This gives the breeder a section of the inner sheath, which is thinner, to insert into the cervix of the animal, before hitting the rubberized tip 82 of the outer sheath. This also allows the breeder to expel the semen as the upper opening 61 of the semen straw 63 corresponds to the opening 74 at the end of the inner sheath 70 and is no longer covered by the rubberized tip 84.

Figure 3:
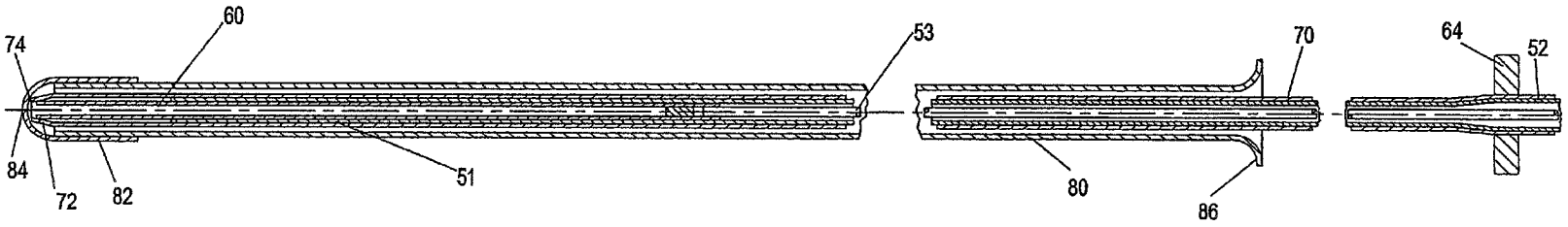
FIG. 3 PRIOR ART
FIG. 3 is a side cross-sectional view of the embodiment of FIGS. 1 and 2.

FIG. 3 is a cross sectional view of one embodiment of the prior art apparatus. It shows the relative diameter of each individual component part. Comparing to FIG. 6, which is a cross-sectional view of one embodiment of the present invention, it is noteworthy that the diameter of the present invention is the same as that of the inner sheath of the prior art invention of FIGS. 1-3.

Figure 4:
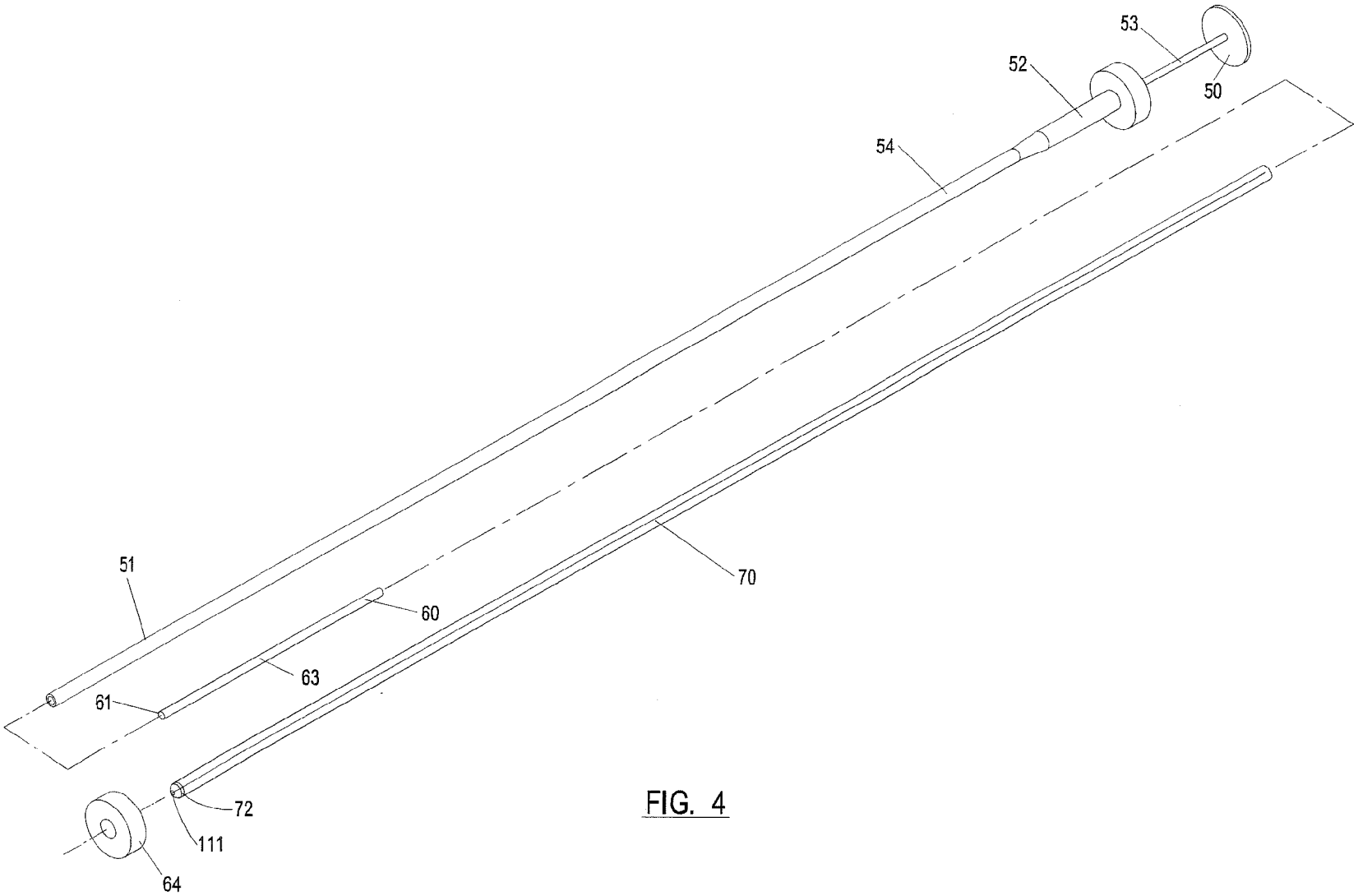
FIG. 4 is a disassembled side schematic view of one embodiment of the artificial insemination apparatus of the present invention.
Figure 5:
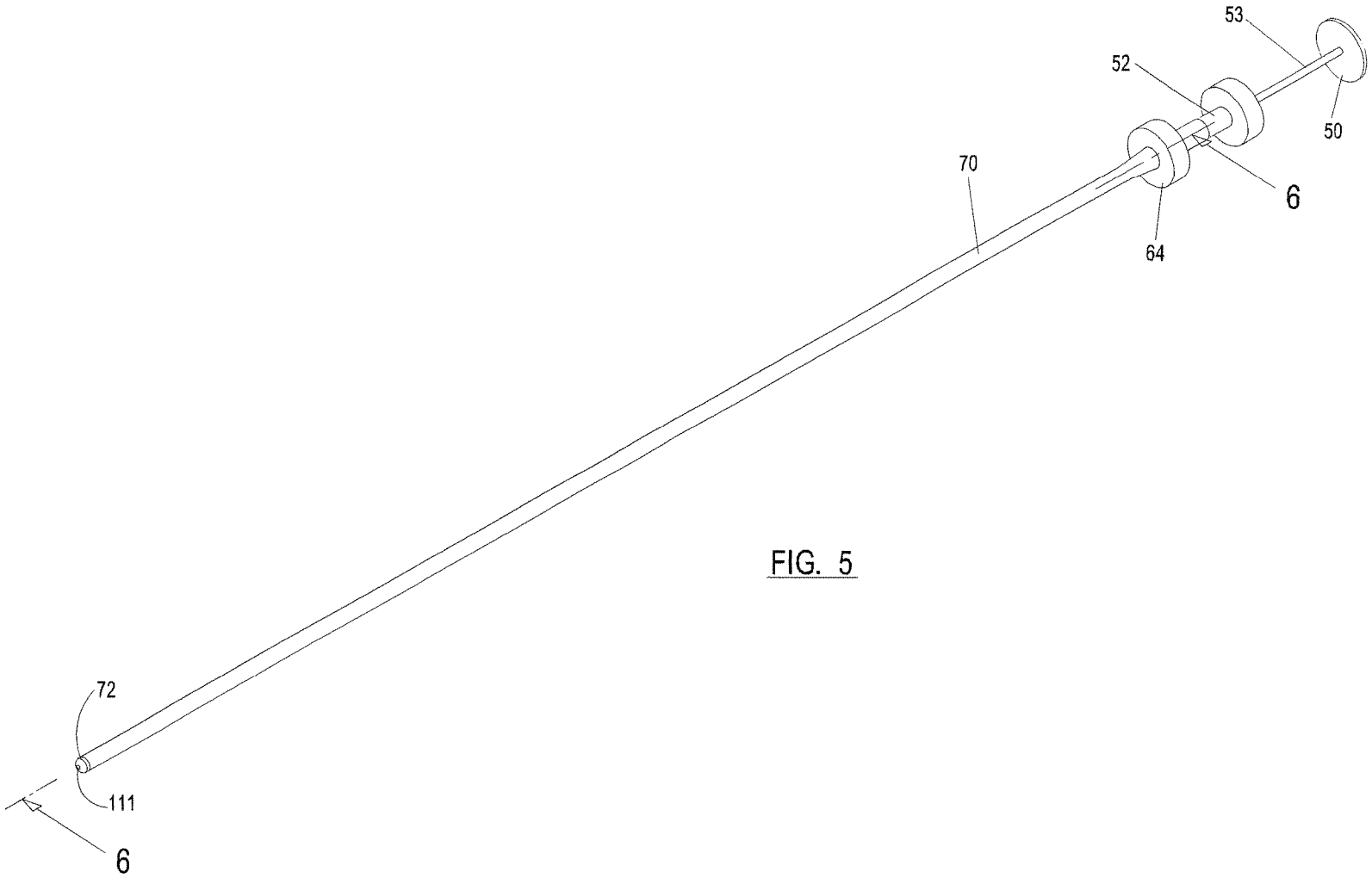
FIG. 5 is an assembled side perspective view of one embodiment of the artificial insemination apparatus of the present invention.

FIG. 4 is a schematic view of one embodiment of the present invention. The present invention relates to an improved sheath 70, which slidably fits over a standard artificial insemination gun assembly 54. A semen straw 63 is inserted into the artificial insemination gun at the end 51 in the same manner as previously discussed in the prior art invention. In addition, the sheath 70 is then slid over the loaded artificial insemination gun and secured using ring 64 in the same manner as the prior art sheath. FIG. 5 shows an assembled gun apparatus of one embodiment of the present invention that includes a sheath 70 with cap 74 installed at the end, the cap having an opening 102 covered by plug 111 at the tip.

Figure 6:
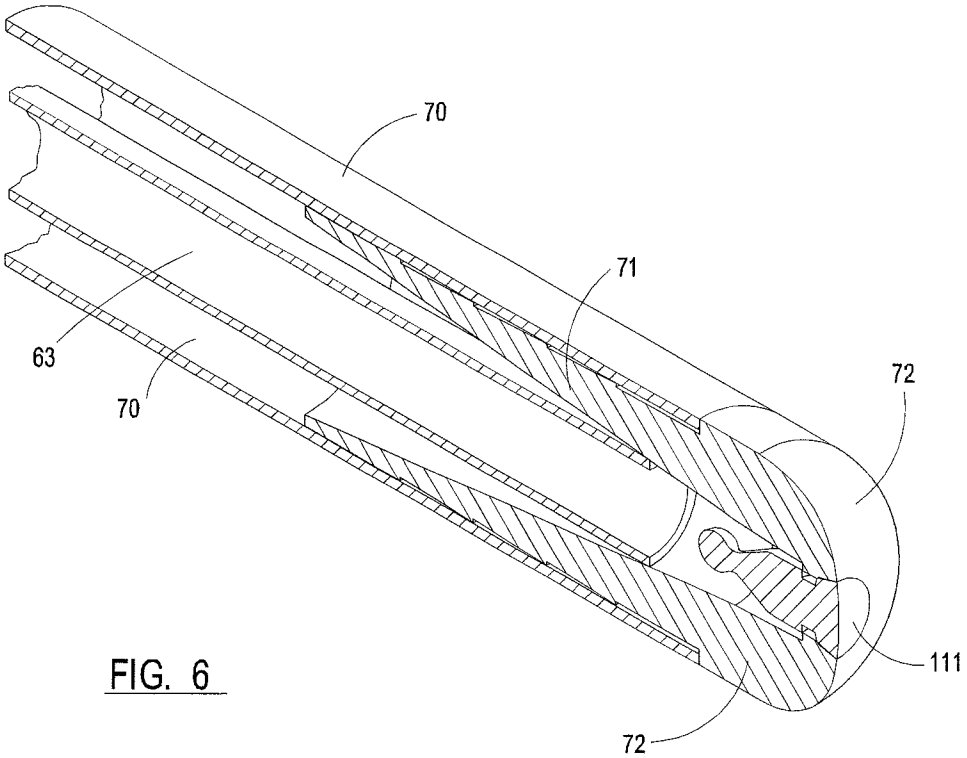
FIG. 6 is a side cross-sectional and perspective view of an embodiment of the invention showing a cap attached to the end of an insemination sheath, and a plug inserted into a unique opening at the end of said cap.
Figure 13:
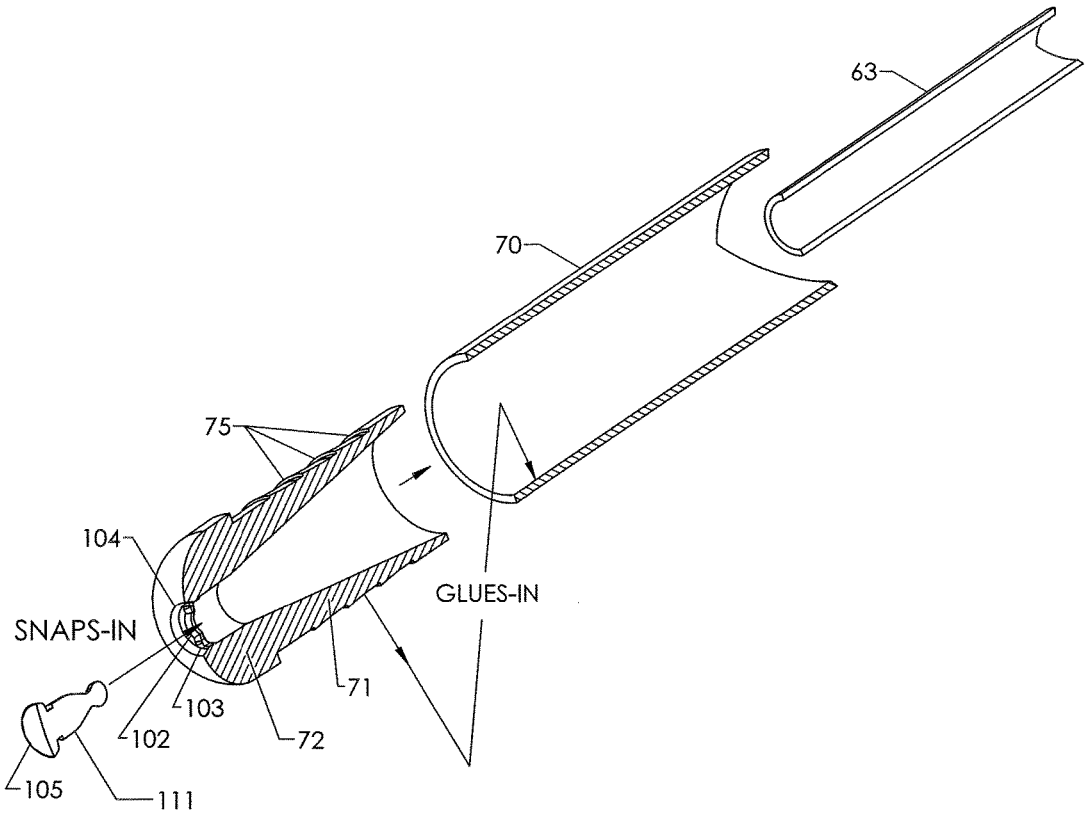
FIG. 13 is an exploded perspective view of the embodiment of FIGS. 9 and 10.
Figure 14A:
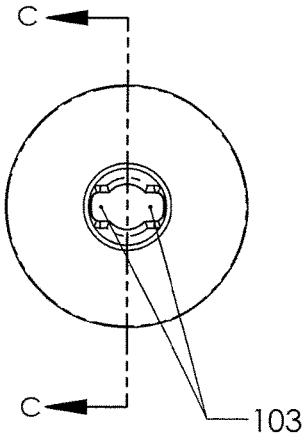
FIG. 14A is an end view of an embodiment of a cap of the present invention showing the unique opening and channels at the end.
Figure 14B:
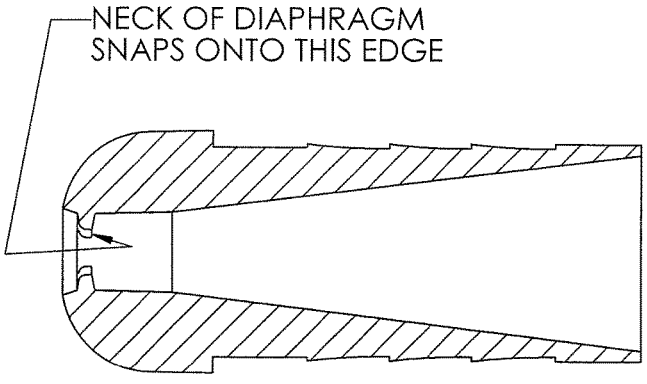
FIG. 14B is a sectional view along line C-C of FIG. 14A.
Figure 14C:
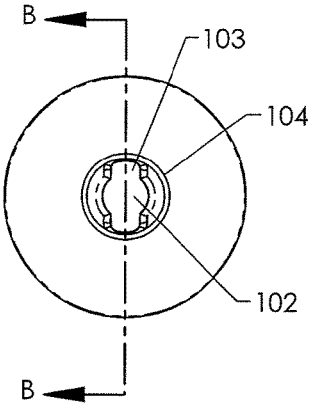
FIG. 14C is an end view of the embodiment of the cap of FIG. 14A, rotated 90 degrees.
Figure 14D:
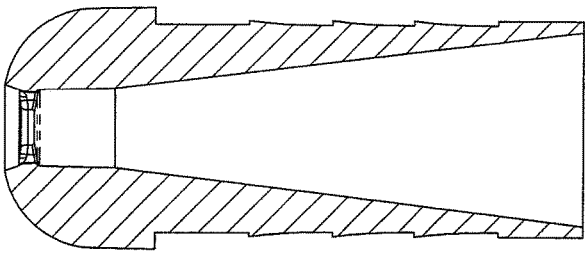
FIG. 14D is a sectional view along line B-B of FIG. 14C.
Figure 15A:
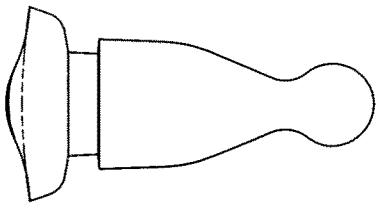
FIG. 15A is a top view of an embodiment of a deformable diaphragm of the present invention during injection.
Figure 15B:
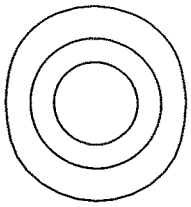
FIG. 15B is an end view of an embodiment of a deformable diaphragm of the present invention during injection.
Figure 15C:
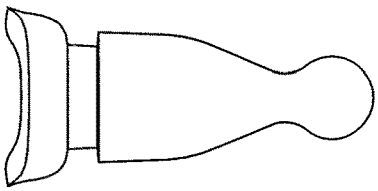
FIG. 15C is a side view of an embodiment of a deformable diaphragm of the present invention during injection.
Figure 15D:
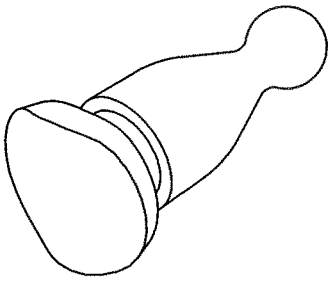
FIG. 15D is an isometric view of an embodiment of a deformable diaphragm of the present invention during injection.
Figure 15E:
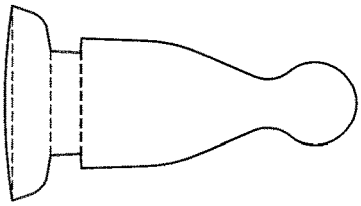
FIG. 15E is a top and side view of an embodiment of a deformable diaphragm of the present invention at rest.
Figure 15F:
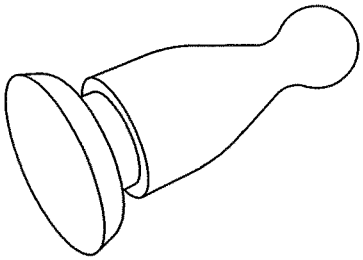
FIG. 15F is an isometric view of an embodiment of a deformable diaphragm of the present invention at rest.

As shown in the cross-sectional view of FIG. 6 and the exploded view of FIG. 13, the exemplary cap 72 of this embodiment of sheath 70 is tapered, narrowing to a rounded end. Cap 72 may have a frustoconical shape. Opening 102 is preferably provided at the end of cap 72 and has a peripheral edge 104 that is wider than the opening itself. Opening 102 also includes one or more channel(s) 103 that are provided within the area defined by peripheral edge 104. The area within peripheral edge 104 may have a concave shape. Opening 102 and channel(s) 103 are completely covered by plug 111 which has a complementary peripheral edge 105 that fits flush against the edge 104 of opening 102 thereby forming a seal. The external surface of plug 111 may have a concave or rounded shape. In some embodiments, a single channel 103 may be provided to focus the flow of semen exiting from the sheath, although multiple channels 103 (preferably two, as illustrated) may be provided. In most embodiments, channel(s) 103 are preferably located adjacent to opening 102 in order to allow room at the center of opening 102 for the body of plug 111. If multiple channels 103 are provided, they are preferably be arranged in a pattern allowing for the widest distribution of semen from the sheath. For example and without limitation, a pair of channels 103 may be provided on opposite sides of opening 102, within peripheral edge 140, as illustrated in the drawings.

The interior portion 71 of cap 72 in this embodiment extends into sheath 70, and is tapered on the inside so as to snugly engage semen straw 63. The extended interior portion 71 includes a plurality of ridges or barbs 75 on the outside which frictionally engage the interior of sheath 70 to prevent the cap 72 from becoming detached from the sheath 70 when fluid pressure is applied to the semen. When such pressure is applied, plug 111 is either deformed or slidably extended out to uncover opening 102 to allow semen to flow out through channels 103.

Figure 7:
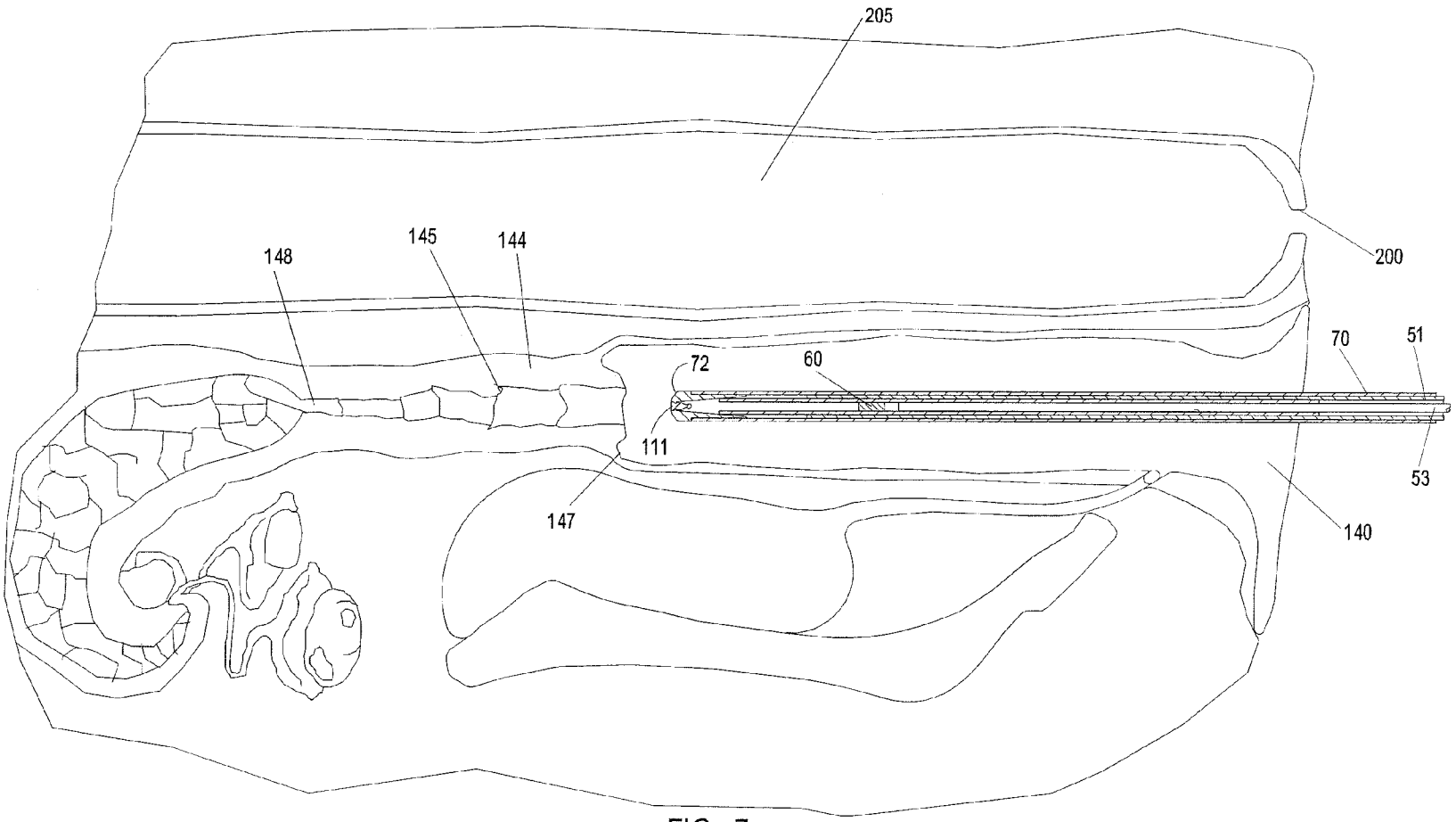
FIG. 7 is a cross-sectional side environmental view of one embodiment of the present invention inserted in the vaginal cavity of a bovine.

FIG. 7 is a cross sectional view of an artificial insemination gun of the present apparatus inserted in the vagina of a bovine. The figure depicts the basic structure of the reproductive tract of a bovine or other livestock. The animal has an anus 200 at the end of the animal's intestinal tract 205. With regard to bovines and other large livestock, the breeder inserts a hand through the anus 200 and into the intestinal tract 205 of the animal. The walls of the intestinal tract of the animal are thin and elastic allowing the breeder to feel and manipulate portions of the reproductive system through the wall of the intestines. The reproductive system of livestock, particularly a bovine, consists of a vagina 140 which extends a distance into the animal to the internal reproductive bodies. The vagina 140 extends to the cervix 144. In general, the cervix is more narrow and rigid than the vagina. The cervix has cervical rings 145 making passage through the cervix 144 difficult. At the end of the vagina 140, there are blind pouches 147, where the vaginal body extends slightly past the opening to the cervix 144. Often times the blind pouches can present an obstacle to the breeder in attempting to insert the artificial insemination gun into the cervix 144. At the end of the cervix is the uterine body 148. The rate of pregnancy is highest when sperm-containing semen is injected as close as possible to the uterine body 148.

Figure 8:
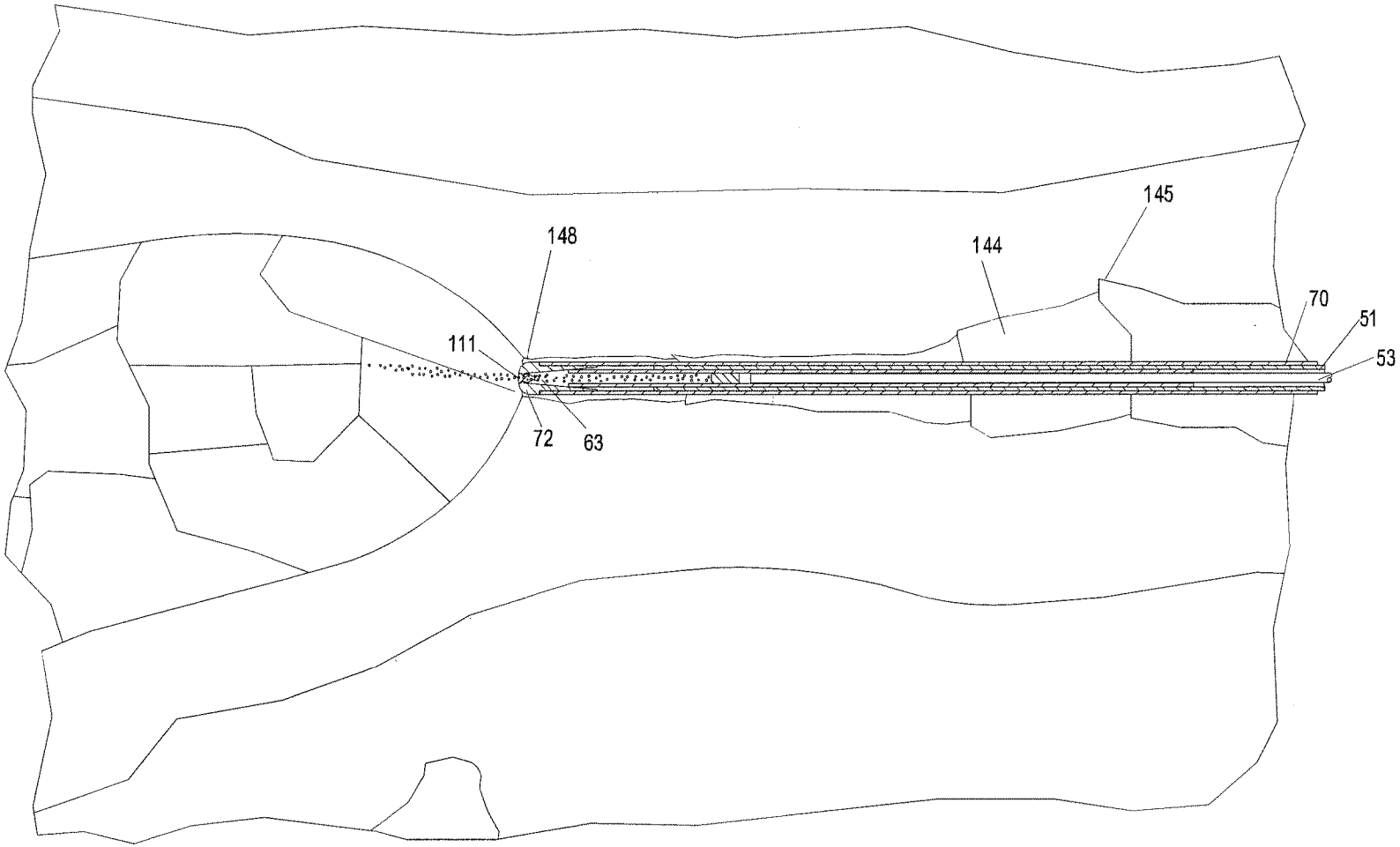
FIG. 8 is a cross-sectional side environmental view of one embodiment of the present invention, showing the tip having been navigated into a bovine cervix and the discharge of semen underway.

FIG. 8 is a cross sectional view of an apparatus of the present invention in the process of injecting semen near the uterine body 148. In this embodiment, the channels 103 of opening 102 at the end of the sheath 70 are exposed through the movement or deformation of plug 111 caused by the application of pressure transferred from the manual force of the user on the plunger flange 50 to the seminal fluid in the semen straw. The pressure on the plug 111, causes it to either move outward or deform (depending on the embodiment), exposing one or more channels 103 through which the semen in the semen straw 63 may exit. A skilled breeder can cause this to occur as close as possible to the uterine body 148. To ensure that the semen is properly dispensed, the plunger should be depressed in a slow steady motion.

Figure 9B:
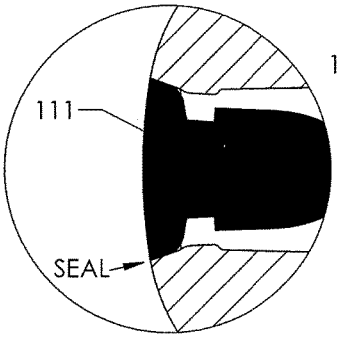
FIG. 9B is a close up view of the end of the insemination sheath of FIG. 9A.
Figure 9A:
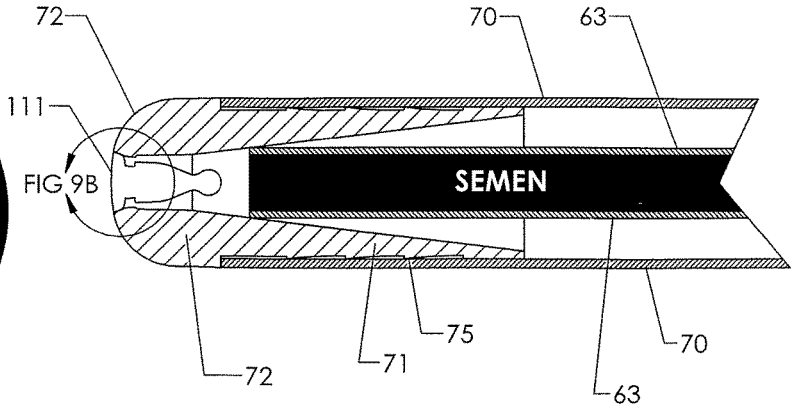
FIG. 9A is a cross-sectional side view of an embodiment of an artificial insemination sheath of the present invention showing a cap with deformable plug or diaphragm attached to the end of an insemination sheath before fluid pressure is applied.
Figure 10:
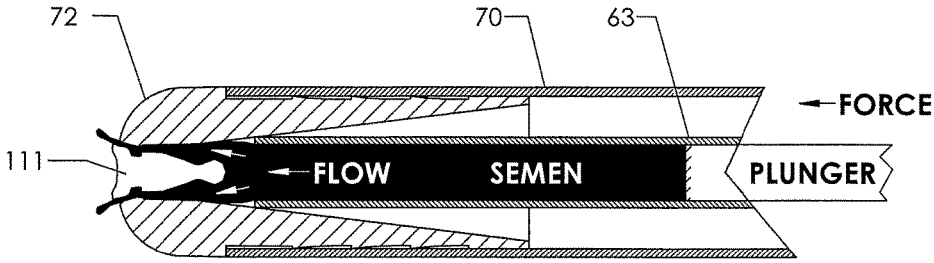
FIG. 10 is a cross-sectional side view of the embodiment of FIG. 9 showing the flow of semen under pressure through side channels opened by a deformed diaphragm.

FIGS. 9 and 10 illustrate an embodiment of a cap 72 of the present invention installed at the end of a sheath 70. FIGS. 9A and 9B show the embodiment before pressure is applied, and FIG. 10 shows the embodiment with pressure applied. In this illustrated embodiment, plug 111 is deformed by the pressure allowing semen to exit through channels 103 of end opening 102.

Figure 11B:
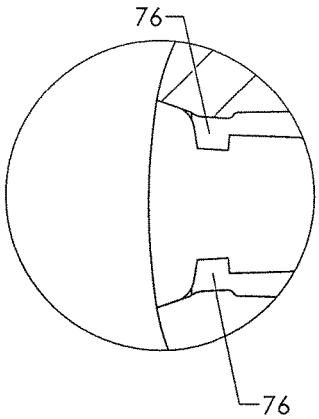
FIG. 11B is a close up view of the end of the cap of FIG. 11A.
Figure 11A:
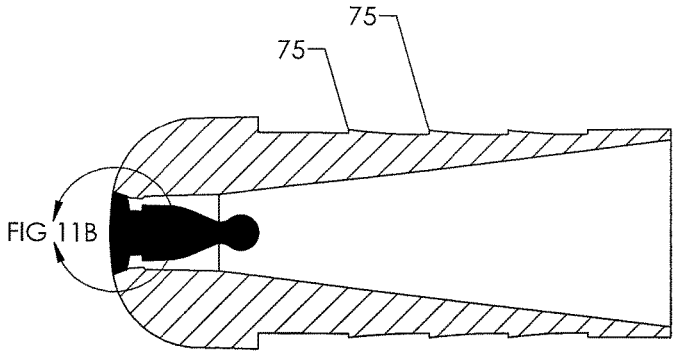
FIG. 11A is a cross-sectional side view of an embodiment of a cap of the present invention showing the position of a deformable plug or diaphragm therein.
Figure 12B:
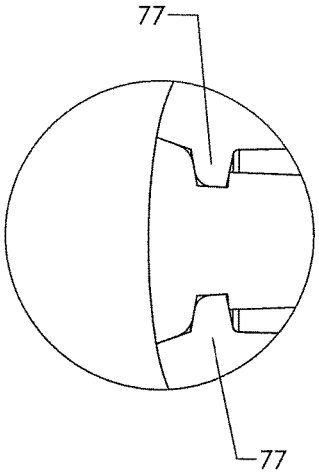
FIG. 12B is a close up view of the end of the cap of FIG. 12A.
Figure 12A:
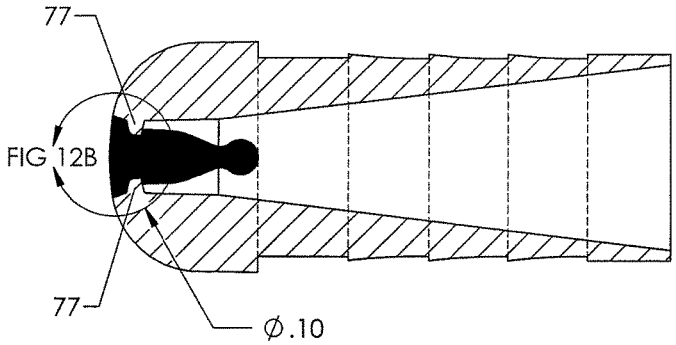
FIG. 12A is a cross-sectional side view of the embodiment of FIG. 11A, rotated 90 degrees, showing the engagement of the plug or diaphragm to the cap.

FIGS. 11 and 12 are cross sectional detail views of the embodiment of FIGS. 9 and 10. FIGS. 11A and 11B depict the plug 111 installed in cap 72 and embodiments of the channels (gaps) 103 of opening 102 through which semen flows under pressure. The views of FIGS. 12A and 12B are rotated 90 degrees from those of FIG. 11, showing stops in the form of extensions 77 on cap 72 which fit into slots 76 in plug 111 which hold plug 111 in place under pressure. Because of this arrangement, when fluid pressure is applied, extensions 77 prevent plug 111 from disengaging from cap 72, but semen under pressure is allowed to exit through openings 103 because of the deformation of plug 111 in these areas.

Figure 16A:
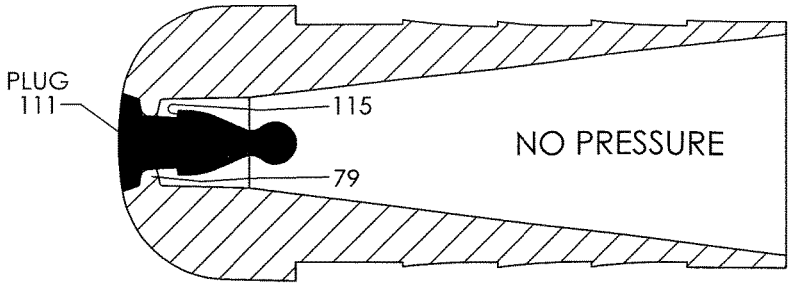
FIG. 16A is a cross-sectional top view of an alternative embodiment of the present invention showing a slidable plug or diaphragm before fluid pressure is applied.
Figure 16B:
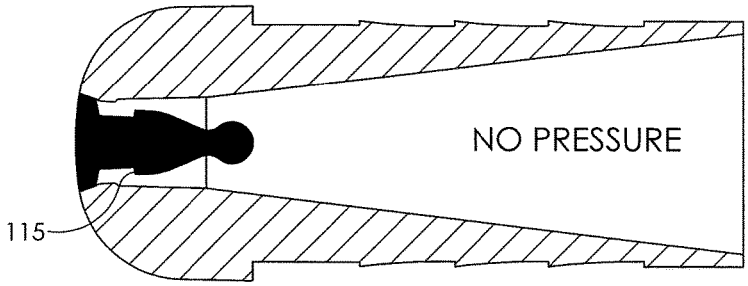
FIG. 16B is a cross-sectional side view of the embodiment of FIG. 16A rotated 90 degrees, showing the slidable plug or diaphragm before fluid pressure is applied.
Figure 17A:
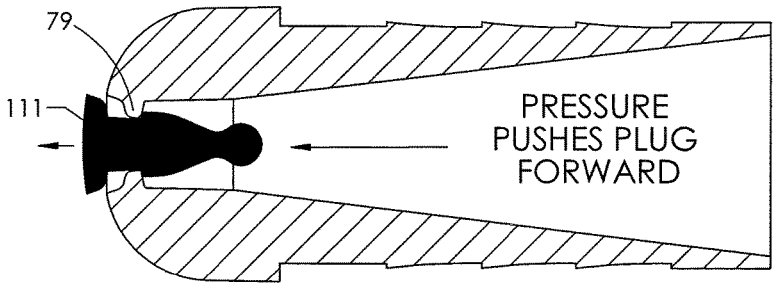
FIG. 17A is a cross-sectional top view of the embodiment of FIGS. 16A-16B showing the slidable plug or diaphragm when fluid pressure is being applied.
Figure 17B:
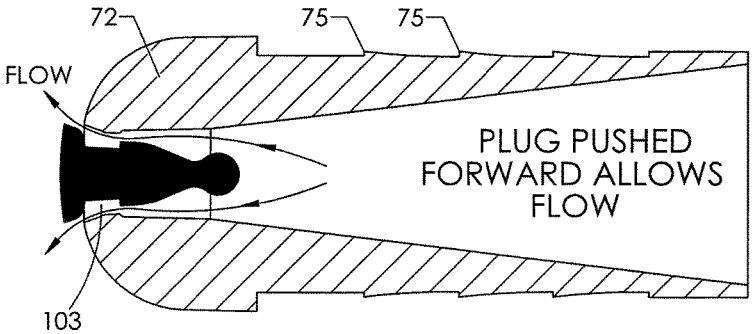
FIG. 17B is a cross-sectional side view of the embodiment of FIG. 17A rotated 90 degrees, showing the slidable plug or diaphragm when fluid pressure is being applied.

FIGS. 16A-B and 17A-B are views of an alternative embodiment of the plug 111 of the present invention. In these illustrated embodiments, the plug 111 covering opening 102 is more rigid, and is designed to move (slide) a short distance when fluid pressure is applied. FIGS. 16A and 16B show the position of plug 111 before pressure is applied, with the outer edge of plug 111 flush with the outer edge of cap 72. When pressure is applied, as shown in FIGS. 17A and 17B, plug 111 does not detach from cap 72, but moves out enough to expose opening 102 and channels 103 which allow semen to exit. The movement of plug 111 is arrested by stops, such as the extensions 115 on the edges of the plug 111 which engage inwardly extending ridges 79 on the inside of the cap structure 72, best shown in FIGS. 16A and 17A. It is to be appreciated that other stop structures may also be utilized to arrest the outward (forward) motion of plug 111 after channel(s) 103 are exposed.

It is to be appreciated that all of the features of all of the embodiments of the cap and plug structures of the present invention may be incorporated into and made part of the outer sheath itself, so that no attachment of a separate cap 72 to a sheath 70 is required. In such embodiments, all of these features (e.g., tapered interior to receive semen straw, opening with channels at rounded end, deformable or slidable plug, stop structures, etc.) are integrated into the end of the sheath itself. It is also to be appreciated that either the deformable plug embodiments, or the slidable plug embodiments may be used with either the attached cap embodiments or the incorporated cap embodiments of the invention.

Finally, it is to be appreciated that different versions of the invention may be made from different combinations of the various features described above. It is to be understood that other variations and modifications of the present invention may be made without departing from the scope thereof. It is also to be understood that the present invention is not to be limited by the specific embodiments disclosed herein, but only in accordance with the appended claims when read in light of the foregoing specification.

What is claimed is:

1. A sheath for use in artificial insemination of an animal comprising an elongated tubular member having a hollow interior, an open proximal end, and a rounded distal end forming a tip, said tip having an end opening therein with a peripheral edge, said opening including at least one channel inside said peripheral edge in communication with the interior of said hollow tubular member, and a separate plug for temporarily covering said opening and temporarily covering said at least one channel, said plug having a body and a rounded exterior surface and a complementary edge that is capable of fitting flush with the peripheral edge of said opening to provide a seal.

2. The sheath of claim 1 wherein said plug is made of a deformable material such that fluid pressure from the interior of said sheath causes said plug to deform and unseal said opening allowing fluid under pressure to exit from the interior of said sheath through said at least one channel.

3. The sheath of claim 1 wherein said plug is movably deployed in said end opening and further comprises at least one stop to prevent said plug from becoming detached from said tip such that fluid pressure from the interior of said sheath causes said plug to become dislodged and unseal said opening allowing fluid under pressure to exit from the interior of said sheath through said at least one channel.

4. The sheath of claim 3 wherein said at least one stop comprises at least one extension on an edge of the body of said plug and at least one inwardly extending ridge on the interior of said hollow tubular member, wherein engagement of said at least one extension against said inwardly extending ridge prevents said plug from exiting through said end opening.

5. The sheath of claim 1 wherein said at least one channel is located on a side of said end opening.

6. The sheath of claim 1 wherein said at least one channel comprises two channels located on opposite sides of said end opening.

7. The sheath of claim 1 wherein the interior of said hollow tubular member is tapered so as to snugly engage a semen straw.

8. A cap for attachment to an end of a hollow artificial insemination sheath, said cap including a rounded end with a tip, said tip having an end opening therein with a peripheral edge, said opening including at least one channel inside said peripheral edge in communication with an interior of said sheath, and a separate plug for temporarily covering said opening and temporarily covering said at least one channel, said plug having a body and a rounded exterior surface and a complementary edge that is capable of fitting flush with the peripheral edge of said opening to provide a seal.

9. The cap of claim 8 wherein said plug is made of a deformable material such that fluid pressure from the interior of said sheath causes said plug to deform and unseal said opening allowing fluid under pressure to exit from the interior of said sheath through said at least one channel.

10. The cap of claim 8 wherein said plug is movably deployed in said end opening and includes at least one stop to prevent said plug from becoming detached from said cap such that fluid pressure from the interior of said sheath causes said plug to become dislodged and unseal said opening allowing fluid under pressure to exit from the interior of said sheath through said at least one channel.

11. The cap of claim 10 wherein said at least one stop comprises at least on extension on an edge of the body of said plug and at least one inwardly extending ridge on the interior of said sheath, wherein engagement of said at least one extension against said inwardly extending ridge prevents said plug from exiting through said end opening.

12. The cap of claim 8 wherein said cap has a diameter that is approximately the same as a diameter of the end of said sheath.

13. The cap of claim 8 wherein said at least one channel is located on a side of said end opening.

14. The cap of claim 8 wherein said at least one channel comprises two channels located on opposite sides of said end opening.

15. The cap of claim 8 further comprising a hollow extension that fits inside said sheath wherein an interior of said extension is tapered so as to snugly engage a semen straw.

16. The cap of claim 15 wherein at least one barb is provided on said cap extension for frictional engagement against an interior wall of said sheath.

17. A method for artificially inseminating an animal comprising the steps of:

a. attaching a sheath in which a semen straw has been properly loaded onto an artificial insemination gun, said sheath having a rounded end with a tip, said tip having an end opening therein with a peripheral edge, said opening including at least one channel inside said peripheral edge in communication with an interior of said sheath, and a separate plug for temporarily covering said opening and temporarily covering said at least one channel, said plug having a rounded exterior surface and a complementary edge that is capable of fitting flush with the peripheral edge of said opening to provide a seal;

b. inserting said sheath into a reproductive tract of the animal;

c. maneuvering the tip to a location near a uterine body of the animal; and d. depositing contents of the semen straw by applying pressure using the gun such that fluid pressure from the contents in said semen straw causes said plug to uncover said at least one channel allowing the contents of the semen straw to exit through said at least one channel.

18. The method of claim 17 wherein said plug is movably deployed in said end opening and includes at least one stop to prevent said plug from becoming detached from said tip such that fluid pressure from the interior of said sheath causes said plug to become dislodged and unseal said opening allowing fluid under pressure to exit from the interior of said sheath through said at least one channel.

19. The method of claim 17 wherein said plug is made of a deformable material such that fluid pressure from the interior of said sheath causes said plug to deform and unseal said opening allowing fluid under pressure to exit from the interior of said sheath through said at least one channel.

20. A cap for attachment to an end of a hollow artificial insemination sheath, said cap including a rounded end with a tip, said tip having an end opening therein with a peripheral edge, said opening including at least one channel inside said peripheral edge in communication with an interior of said sheath, and a movable plug made of deformable material for temporarily covering said opening and temporarily covering said at least one channel, said plug having a body and a rounded exterior surface and a complementary edge that is capable of fitting flush with the peripheral edge of said opening to provide a seal, such that fluid pressure from the interior of said sheath causes said plug to deform and unseal said opening allowing fluid under pressure to exit from the interior of said sheath through said at least one channel.

21. The cap of claim 20 further comprising a hollow extension that fits inside said sheath wherein an interior of said extension is tapered so as to snugly engage a semen straw.

22. The cap of claim 21 wherein at least one barb is provided on said cap extension for frictional engagement against an interior wall of said sheath.

23. The cap of claim 20 wherein said at least one channel is located on a side of said end opening.

24. The cap of claim 20 wherein said at least one channel comprises two channels located on opposite sides of said end opening.

25. The cap of claim 20 wherein said cap has a diameter that is approximately the same as a diameter of the end of said sheath.

26. A cap for attachment to an end of a hollow artificial insemination sheath, said cap including a rounded end with a tip, said tip having an end opening therein with a peripheral edge, said opening including at least one channel inside said peripheral edge in communication with an interior of said sheath, and a movable plug for temporarily covering said opening and temporarily covering said at least one channel, said plug having a body and a rounded exterior surface and a complementary edge that is capable of fitting flush with the peripheral edge of said opening to provide a seal, wherein said plug is deployed in said end opening and includes at least one stop to prevent said plug from becoming detached from said cap such that fluid pressure from the interior of said sheath causes said plug to become dislodged and unseal said opening allowing fluid under pressure to exit from the interior of said sheath through said at least one channel.

27. The cap of claim 26 further comprising a hollow extension that fits inside said sheath wherein an interior of said extension is tapered so as to snugly engage a semen straw.

28. The cap of claim 27 wherein at least one barb is provided on said cap extension for frictional engagement against an interior wall of said sheath.

29. The cap of claim 26 wherein said at least one channel is located on a side of said end opening.

30. The cap of claim 26 wherein said at least one channel comprises two channels located on opposite sides of said end opening.

31. The cap of claim 26 wherein said cap has a diameter that is approximately the same as a diameter of the end of said sheath.

32. The cap of claim 26 wherein said at least one stop comprises at least on extension on an edge of the body of said plug and at least one inwardly extending ridge on the interior of said sheath, wherein engagement of said at least one extension against said inwardly extending ridge prevents said plug from exiting through said end opening.

* * * * *